United States Patent [19]

Laurent

[11] 4,210,019

[45] Jul. 1, 1980

[54] OVERHEAD CABLE TRANSPORT TESTING

[75] Inventor: Roger Laurent, Chambery, France

[73] Assignee: Pomagalski S.A., Fontaine, France

[21] Appl. No.: 34,026

[22] Filed: Apr. 27, 1979

[30] Foreign Application Priority Data

May 2, 1978 [FR] France ..... 78 13032

[51] Int. Cl.[2] ..... G01M 19/00

[52] U.S. Cl. ..... 73/158; 104/179

[58] Field of Search ..... 73/146, 158, 9, 432; 104/112, 173 R, 173 ST, 178, 179; 340/670, 671; 361/238

[56] References Cited

FOREIGN PATENT DOCUMENTS

| | | | |
|---|---|---|---|
| 2610716 | 10/1976 | Fed. Rep. of Germany | 73/158 |
| 2340848 | 2/1977 | France | 104/178 |
| 295881 | 3/1954 | Switzerland | 73/158 |

*Primary Examiner*—S. Clement Swisher

*Attorney, Agent, or Firm*—Stevens, Davis, Miller & Mosher

[57] ABSTRACT

Overhead cable transport installation including a device for testing the clamping of the grips coupling a gondola carriage on to the cable. A test wheel is driven with a speed synchronous with that of the cable before the carriage is engaged on the test wheel and is braked during the slip detection phase.

7 Claims, 1 Drawing Figure

OVERHEAD CABLE TRANSPORT TESTING

Figure 1:
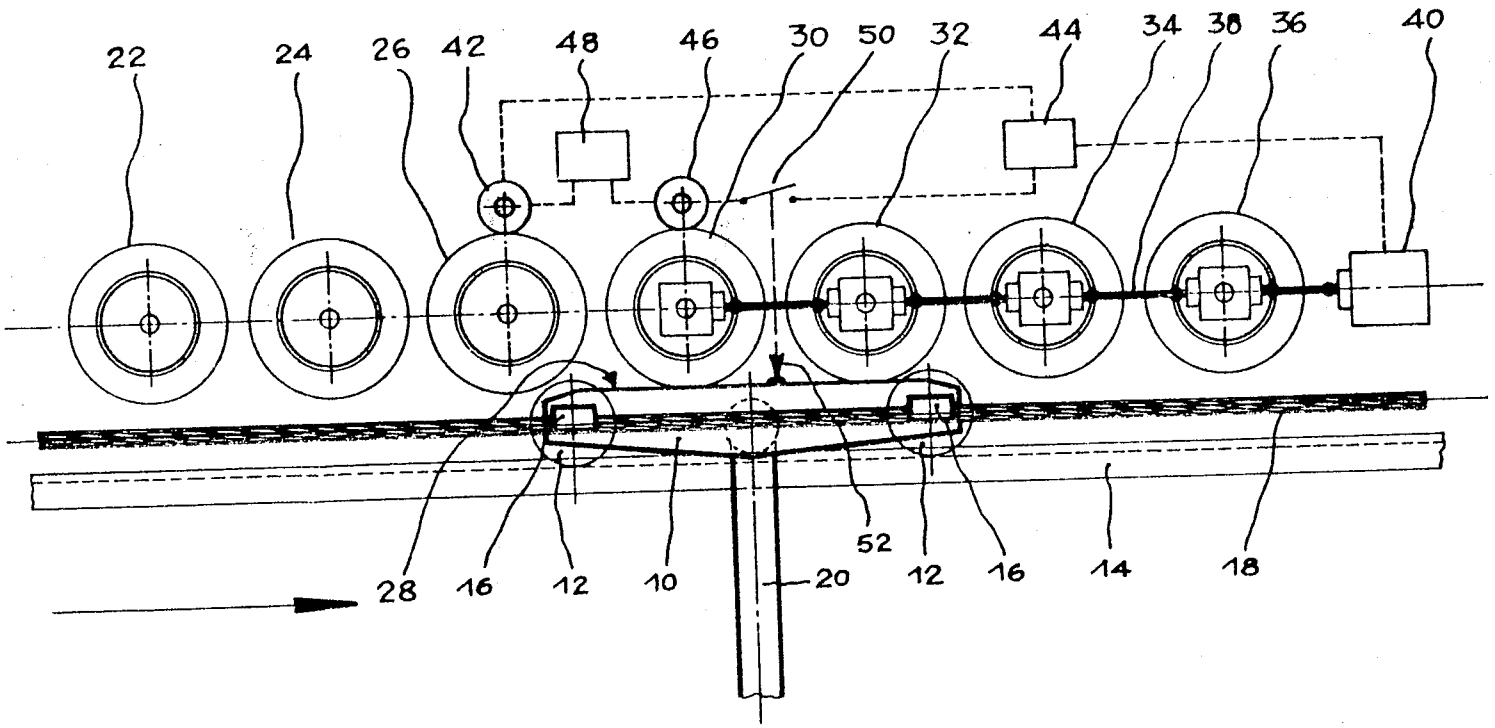

The invention relates to an overhead cable transport installation, in particular a gondola lift, comprising at least a carriage with detachable grip for coupling a gondola on to the cable, a device for accelerating and synchronizing the said carriage before its coupling on the cable, with at least one synchronizing wheel engaging the said carriage by friction in the area above the coupling point, in relation to the direction of travel of the cable and driven by rotation at a tangential speed synchronous to the cable, and a device for testing the clamping of the said grip in the area below the said coupling point capable of exerting on the carriage coupled on the cable a braking or accelerating force.

One known installation of the type mentioned has a thrust system fitted in the trajectory over which moves the carriage with grip and which is capable of exerting on the latter an opposing braking or accelerating force.

When the grip is correctly clamped on the cable, the carriage overcomes this opposing force and continues its travel without slipping on the cable. If on the contrary, the clamping is insufficient, the opposing force makes the grip slip on the cable and this slipping is detected by any appropriate means. The opposing force applied to the carriage is fixed by regulations according to the characteristics of the installation, for example by the formula $1.5 \times p \sin \alpha$, p being the total weight of the gondola and the load transported, and $\alpha$ the maximum angle of inclination of the cable along the line.

The thrust system causes shocks and oscillating movements of the cable and the gondola which are particularly troublesome. The detection device is complicated and is incapable of taking into account variations in the speed of the haulage cable.

Another known installation has a carriage thrusting or braking chain capable of exerting an opposing testing force. The dynamic force necessary for driving this chain causes vibration and oscillation incompatible with the correct operation of the measuring device.

The object of the present invention is to remedy these disadvantages and to permit the execution of a particularly simple and reliable installation.

The installation according to the present invention is distinguished by the fact that the said device for testing the clamping has at least one test wheel capable of engaging the said carriage by friction, a means of rotating the said test wheel to bring this to a speed synchronous with that of the cable before the carriage is engaged on the said test wheel and to exert on the said test wheel an opposing force tending to impose on the test wheel a speed different from that of the cable during the said engagement and a detector of a differential speed between the said test wheel and the said cable.

The device for testing the clamping of the grips can be added to a standard installation without any modification of this, and can be installed on an existing gondola lift. The test wheels, advantageously equipped with a pneumatic tire, are arranged so as to follow the usual synchronizing wheels, and in accordance with a development of the invention, the slipping of the grip on the cable is signaled by the detection of a difference in speed between the synchronizing wheels and the test wheels. In standard installations, the synchronizing wheels are driven at a speed synchronous with that of the cable, in particular by a direct take-off of movement from the cable.

The test wheels are driven by a motor at a speed synchronous with that of the cable, and during the slip detection phase, the motor is transformed into a generator exerting the opposing force on the carriage. The motor may be electric, mechanical or pneumatic, the electric motor being easily synchronized with the running speed of the cable.

According to a development of the invention the opposing forces exerted on the carriage is a holding-back force easily obtained in the case of an electrical drive by the simple interruption of the power supply to the motor. The holding-back force is applied gradually, and avoids any violent shock that could involve jerks or oscillating of the cable or the gondolas.

The need to take into consideration variations in the speed of the cable, due in particular to variations in the load, is avoided, by detecting a difference in speed between the synchronizing wheel and the test wheel. This difference may be observed by coupling a tachometric generator with the synchronizing wheel and to the test wheel a second tachometric generator the signals from which are transmitted to a unit detecting the difference. This particularly simple test system makes it possible to verify the correct operation of the drive or testing device during the phase preceding the testing of the clamping and to indicate any slipping of the grip during the test phase.

The installation advantageously includes a means for testing the correct positioning of the grips clamped on the cable. This test is carried out by means of geometrical gauges installed in the trajectory followed by the moving grips and indicating any incorrect positioning.

Other advantages and features will emerge more clearly from the following account of a mode of application given as a non-restrictive example, and shown in the attached drawing, in which the single FIGURE shows schematically a device for testing the clamping of a grip in accordance with the invention.

In the FIGURE, a carriage 10 runs on wheels 12 on a rail 14 of a terminal station of an overhead cable transport installation, in particular of a gondola lift. Carriage 10 is equipped with grips 16 for coupling on to a haulage-track cable 18 extended between the two terminals. A gondola (not shown) is carried by a suspension 20 hinged on the grip carriage 10. The grips 16 are of the detachable type permitting the uncoupling of the carriage 10 from the cable 18 in the terminals and the running at a slow speed or the stopping of the gondola at the loading or unloading platforms. At the exit from the station, the carriage 10 is accelerated, by gravity for instance, by running on an inlined section of rail, and its speed is synchronized with that of the cable 18 by means of three synchronizing wheels 22, 24, 26 engaging a running surface 28 provided on the upperside of the carriage 10. The synchronizing wheels 22, 24, 26 equipped with pneumatic tyres, are staggered in the direction of travel of the carriage 10, indicated by an arrow in the FIGURE, and are rotated at a linear speed equal to that of the cable 18 by a movement take-off (not shown) on cable 18 of a type well known to experts. A control device (not shown) situated at the level of the synchronizing wheel 24, brings about the closing of the grips 16 and the coupling of carriage 10 on to the cable 18, which then hauls the carriage 10. In the position of carriage 10 shown in the FIGURE, the grips 16 have just been closed on the cable 18 and the carriage 10 enters the section for the testing of the clamping of grips 16.

Four wheels 30, 32, 34, 36, identical with synchronizing wheels 22, 24, 26, are staggered along the test section, and each of these is equipped with a pneumatic tire which engages running surface 28. The test wheels 30 to 36 are interconnected by means of universal joint transmissions 38, and also connected with a motor 40. The latter can be an hydraulic motor or advantageously a direct current electric motor. The transmissions 38 ensure a perfect synchronization of the rotation speeds of test wheels 30 to 36, and the assembly of synchronizing wheels 22 to 26 and test wheels 30 to 36 is mounted on a frame (not shown), adjustable in height in relation to rail 14 in order to ensure parallelism and an equality of the pressures transmitted to the carriage 10 by the various wheels.

The synchronizing wheel 26 drives a tachometric generator 42, the signal from which is transmitted to a unit 44 supplying power to and monitoring motor 40. The test wheel 30 drives a tachometric generator 46, identical with generator 42, and the signals emitted by the generators 42, 46 are applied to a detection unit 48, signalling any difference in speeds between the generators 42, 46. The power supply and monitoring unit 44 receives a signal on the entering of the test section by carriage 10, emitted by a switch 50, actioned by a thrust 52 acting in conjunction with the running surface 28 of the carriage 10.

The generator 42 controls the power supply and monitoring unit 44, in such manner as to impose a speed of rotation of test wheels 30 to 36 by the motor 40 perfectly synchronous with the running speed of the cable 18. At the entrance to the test section, are fitted geometrical gauges, of a known type, which verify the correct position of the clamping jaws of the grips 16 in the closed position, clamped on the cable 18.

The testing device operates in the following manner:

The synchronizing wheels 22, 24, 26, driven directly by the cable 18, rotate constantly at a speed synchronous with that of the cable 18. This speed is measured by the generator 42 and the monitoring and power supply unit 44 controls the motor 40 so as to drive the test wheels 30 to 36 at the same speed during the periods of absence of a carriage 10 from the test section, these periods being signalled by the closing of the switch 50. A carriage 10 that has to be coupled on to the cable 18, and accelerated by gravity, is engaged under the synchronizing wheels 22, 24, 26, so as to move at the same speed as the cable 18 when the grips 16 are closed, which takes place at the wheel 24. The correct closing of the grip jaws is checked by the geometrical gauges (not shown) which bring about the stopping of the installation in the case of an incorrect positioning. In the case of correct positioning, the carriage 10 continues its travel, and is engaged under test wheels 30 to 36, which rotate at the same speed, this engagement being signalled by the switch 50 which opens and cuts the power supply to the motor 40. The engaging takes place without any shock and on the opening of the switch 50 the motor acts as a brake driven by the wheels 30 to 36. The braking effort is gradual and be accentuated or regulated by the insertion of an electrical resistance (not shown). The cable 18 hauls the carriage along the test section against the opposing force exerted by the wheels 30 to 36, the motor 40 operating as a braking generator. If the grips 16 are correctly clamped, the carriage 10 pursues its travel at the same speed as the cable 18 without any slipping of the grips. When there is incorrect clamping, the braking force exerted by the test wheels 30 to 36 on the carriage 10 causes the slipping of the grips 16 on the cable 18, and the speed of movement of the carriage 10 becomes lower than that of the cable 18. The detector 48 signals any difference in speed between the synchronizing wheels 22, 24, 26 and the test wheels 30 to 36. During the test phase the speed of the test wheels corresponds with that of the carriage 10, and in the case of the slipping of the grips 16 this speed is different from that of the cable 18, corresponding with that of the synchronizing wheels 22 to 26. This difference in speed due to a slipping of the grips 16, is signalled by the detector 48, which advantageously causes the stopping of the installation. The switch 50 may be of the delayed-action type, closing after the carriage 10 has passed on to the test section. On the closing of the switch 50 the motor 40 supplied with normal power imposes on the test wheels 30 to 36 a speed synchronous with that of the synchronizing wheels 22 to 26. The detector 48 also signals any synchronization defect, that is any malfunctioning of the motor 40 regulating device.

It is easily seen that the test device functions independently of the running speed of the cable, any variation in speed being automatically repercuted on the speed of the synchronizing wheels 22 to 26 and the test wheels 30 to 36, without actioning of the detector 48. The difference in speed between the wheels 26, 30 can obviously be detected in a different manner, in particular by a mechanical, phonic or optical sensor, and the scope of the invention will not be exceeded by modifying the number of synchronizing or test wheels and in using a different means of driving and/or braking the test wheels 30 to 36. The test device according to the invention is advantageously installed at the exit of each terminal, and if necessary of intermediate stations of the installation, the test being carried out on all the gondolas, whether loaded or empty. The test device has been described in its preferred mode of application, in conjunction with the device for synchronization and coupling of the carriage on the cable, but it is clear that the test may be effected at a different position, the synchronizing wheel then serving only as a wheel to measure the running speed of the cable 18. The test may be effected by an oversupply to the motor 40 tending to accelerate the gondolas 10, the testing force being applied in both cases gradually, and in a perfectly controllable manner, to avoid any shock or oscillation. The test device makes use of standard components and can be easily mounted on an existing installation or supplied at the customer's request without any great modification of the standard installation.

What is claimed is:

1. An overhead cable transport installation, including at least one detachable grip carriage for coupling a gondola on to the cable, a device to accelerate and synchronize the said carriage prior to its coupling on the cable having at least one synchronizing wheel engaging the said carriage by friction in the area above the coupling point, and rotated at a tangential speed synchronous with that of the cable and a device for testing the clamping of the said grip below the said coupling point able to exert on the said carriage coupled on the cable a braking or accelerating force, the said device for testing the clamping including at least one test wheel able to engage the said carriage by friction, a means of rotating the said test wheel to drive it at a speed synchronous with that of the cable before the engagement of the said carriage on the said wheel, and of exerting on the said test wheel an opposing force tending to impose on the test wheel a speed different from that of the cable during the said engagement, and a detector of the differential speed between the said test wheel and the said cable.

2. An installation in accordance with claim 1, the said synchronizing wheel and the said test wheel being both equipped with a pneumatic tire, the trend of which works on a running surface provided on the carriage.

3. An installation in accordance with claim 1, having a plurality of synchronizing wheels and test wheels staggered along the trajectory over which moves the said carriage in the sections above and below the said coupling point.

4. An installation in accordance with claim 1, the said plurality of test wheels being positively interconnected and with a driving component.

5. An installation in accordance with claim 1, the said detector being so devised as to signal any difference in speed between the said synchronizing wheel and the said test wheel.

6. An installation in accordance with claim 5, having a first tachometric generator coupled with the synchronization wheel and a second tachometric generator coupled with the test wheel, the said detector signalling any difference between the signals emitted by the said tachometric generators.

7. An installation in accordance with claim 1, having an electric motor to drive the said test wheel and designed to exert a braking force during the clamping test-phase.

* * * * *